US009651281B2

(12) United States Patent
Jeon

(10) Patent No.: US 9,651,281 B2
(45) Date of Patent: May 16, 2017

(54) ALTERNATING TYPE HEAT PUMP

(76) Inventor: Chang Duk Jeon, Chungju (KR)

( * ) Notice: Subject to any disclaimer, the term of this patent is extended or adjusted under 35 U.S.C. 154(b) by 825 days.

(21) Appl. No.: 13/810,503

(22) PCT Filed: Jul. 7, 2011

(86) PCT No.: PCT/KR2011/004958
§ 371 (c)(1),
(2), (4) Date: Feb. 11, 2013

(87) PCT Pub. No.: WO2012/011688
PCT Pub. Date: Jan. 26, 2012

(65) Prior Publication Data

US 2013/0139533 A1 Jun. 6, 2013

(30) Foreign Application Priority Data

Jul. 21, 2010 (KR) ..... 10-2010-0070410
Jun. 20, 2011 (KR) ..... 10-2011-0059725

(51) Int. Cl.
*F25D 21/06* (2006.01)
*F25B 13/00* (2006.01)
(Continued)

(52) U.S. Cl.
CPC ..... *F25B 30/02* (2013.01); *F25B 13/00* (2013.01); *F25B 47/02* (2013.01);
(Continued)

(58) Field of Classification Search
CPC ..... F25B 30/02; F25B 47/02; F25B 13/00; F25B 2313/0251; F25B 2313/02533; F25B 2313/02741; F25B 49/02
(Continued)

(56) References Cited

U.S. PATENT DOCUMENTS 3,381,487 A * 5/1968 Harnish ..... F25B 13/00 62/117
4,653,287 A * 3/1987 Martin, Jr. ..... F24D 11/0214 237/2 B
(Continued)

FOREIGN PATENT DOCUMENTS

JP 50105962 U 8/1975
JP 2004-108334 A 4/2004
(Continued)

OTHER PUBLICATIONS

Korean Intellectual Property Office/ISA, International Search Report issued on Feb. 10, 2012 on Application No. PCT/KR2011/004958.
(Continued)

*Primary Examiner* — Henry Crenshaw
(74) *Attorney, Agent, or Firm* — Perkins IP Law Group LLC; Jefferson Perkins

(57) ABSTRACT

An alternating type heat pump has first to third rows of outdoor unit coils adapted to selectively perform the functions of an evaporator and a condenser in accordance with the outdoor conditions and the load variations, thereby improving the performance of the heat pump, and is capable of allowing the first to third rows of outdoor unit coils to be operated as a condenser in an alternating manner under the conditions where frost on the outdoor unit coils may be formed especially in winter seasons, thereby basically preventing the conditions on which the frost is formed.

3 Claims, 8 Drawing Sheets

(51) Int. Cl.

| | |
|---|---|
| ***F25B 1/00*** | (2006.01) |
| ***F25B 27/00*** | (2006.01) |
| ***B60H 1/00*** | (2006.01) |
| ***F24D 11/02*** | (2006.01) |
| ***F25B 30/02*** | (2006.01) |
| ***F25B 47/02*** | (2006.01) |

(52) U.S. Cl.
CPC ..... *F25B 2313/0251* (2013.01); *F25B 2313/02533* (2013.01); *F25B 2313/02741* (2013.01)

(58) Field of Classification Search
USPC ..... 62/151, 324.6, 228.3, 238.7, 324.1; 165/202; 237/2 B
See application file for complete search history.

(56) References Cited

U.S. PATENT DOCUMENTS 5,063,752 A * 11/1991 Nakamura ..... F24F 3/065 62/160
5,237,833 A * 8/1993 Hayashida ..... F24F 3/065 62/228.1
6,244,057 B1 * 6/2001 Yoshida ..... F25B 13/00 62/151
6,945,073 B2 9/2005 Matsumoto et al.
2004/0035132 A1 * 2/2004 Park ..... F25B 13/00 62/324.1
2004/0134215 A1 * 7/2004 Park ..... F25B 13/00 62/324.1
2005/0103487 A1 * 5/2005 Aflekt ..... B60H 1/00907 165/202
2006/0254294 A1 * 11/2006 Shimamoto ..... F24F 3/065 62/238.7
2007/0234752 A1 * 10/2007 Otake ..... F25B 29/003 62/324.6
2008/0197206 A1 * 8/2008 Murakami ..... F25B 13/00 237/2 B
2009/0049857 A1 * 2/2009 Murakami ..... F25B 13/00 62/324.6
2010/0146998 A1 * 6/2010 Tomioka ..... F25B 13/00 62/228.3

FOREIGN PATENT DOCUMENTS

JP 2004108334 A 4/2004
JP 2008-164200 A 7/2008

OTHER PUBLICATIONS

Korean Intellectual Property Office/ISA, International Search Report issued on Application No. PCT/KR2011/004958 on Feb. 10, 2012.

* cited by examiner

ALTERNATING TYPE HEAT PUMP

TECHNICAL FIELD

The present invention relates to an alternating type heat pump that has first to third rows of outdoor unit coils adapted to selectively perform the functions of an evaporator and a condenser in accordance with the outdoor conditions and the load variations, thereby improving the performance of the heat pump, and that is capable of allowing the first to third rows of outdoor unit coils to be operated as a condenser in an alternating manner under the conditions where frost on the outdoor unit coils may be formed especially in winter seasons, thereby basically preventing the conditions on which the frost is formed.

BACKGROUND ART

FIG. 1 shows a schematic circuit diagram showing a standard heating operation of a heat pump according to a conventional practice (which is disclosed in Korean Patent Registration No. 10-0965057 entitled 'heat pump' as filed by the same applicant as this invention, wherein the heat pump 10 includes a compressor 200, a four-way valve 210, an indoor unit 220, check valves 240, expansion valves 230, a three-way valve 250, an outdoor unit main coil 90, an outdoor unit auxiliary coil 100, an outdoor unit blower 110, and an accumulator 270.

As shown in FIG. 1, under the standard heating conditions (having the air of more than 5° C. in the outdoor unit) where no frost is formed, the outdoor unit main coil 90 and the outdoor unit auxiliary coil 100 are all operated as an evaporator to optimize the evaporating capability, thereby improving the performance of the heat pump.

FIG. 2 shows a schematic circuit diagram showing defrosting and heating operations of the heat pump according to the conventional practice under the outdoor air conditions where frost is formed. In the state where the outdoor air has a high humidity and a temperature in a range between −2° C. and 2° C., if the outdoor unit auxiliary coil 100 is operated as the condenser so as to suppress or delay the frosting on the outdoor unit coils during the heating operation of the heat pump, the outdoor air becomes warm via the outdoor unit auxiliary coil 100 and the warm air is then passed through the outdoor unit main coil 90, such that the frosting on the outdoor unit main coil 90 can be delayed or suppressed.

However, if high temperature and high pressure refrigerant flow, which is emitted from the compressor 200 and introduced to the outdoor unit auxiliary coil 100, is low, the air passed through the outdoor unit auxiliary coil 100 cannot be sufficiently heated, thereby failing to obtain perfect defrosting effects. Contrarily, if the refrigerant flow introduced to the outdoor unit auxiliary coil 100 is high, the formation of the frost can be suppressed or delayed for a long period of time, but an amount of refrigerant flowing toward the indoor unit 220 for a heating operation becomes reduced to provide poor heating capability.

So as to solve the above-mentioned problems conflicting with each other, there is a need for the development of a method and device that produces an optimal amount of refrigerant satisfying both of heating capability (COP: coefficient of performance) of a heating pump and a delay time period in the formation of frost as user's desired levels and that accurately distributes the amount of refrigerant to the outdoor unit auxiliary coil 100 and the indoor unit 220.

However, it is difficult to find such method and device from the products used in practice.

SUMMARY OF INVENTION

Technical Problem

Accordingly, the present invention has been made in view of the above-mentioned problems occurring in the prior art, and it is an object of the present invention to provide an alternating type heat pump that has first to third rows of outdoor unit coils adapted to selectively perform the functions of an evaporator and a condenser in accordance with the outdoor conditions and the load variations, thereby improving the performance of the heat pump, and that is capable of allowing the first to third rows of outdoor unit coils to be operated as a condenser in an alternating manner under the conditions where frost on the outdoor unit coils may be formed especially in winter seasons, thereby basically preventing the conditions on which the frost is formed.

It is another object of the present invention to provide an alternating type heat pump that has first to third three-way valves disposed at the front ends of first to third rows of outdoor unit coils and a fourth three-way valve disposed at the rear end of the first row of outdoor unit coil, such that the rows of outdoor unit coils having the conditions where frost is formed in the first to third rows of outdoor unit coils constituting an outdoor unit are selectively operated as a condenser in accordance with the opening/closing order and method of the three-way valves during a heating operation, thereby perfectly preventing the frost from being formed and further improving the performance of the heat pump.

It is still another object of the present invention to provide an alternating type heat pump that has first to third rows of outdoor unit coils all operated as a condenser during the cooling operation of the heat pump, thereby optimizing the condensing capability, and that makes use of the first row of outdoor unit coil as an evaporator, if an outdoor air temperature is raised in the hottest weather of more than 40° C. and a temperature difference between the outdoor air temperature and refrigerant is decreased to drastically reduce the condensing capability of the outdoor unit coils, such that the cooled air through the first row of outdoor unit coil is introduced gently to the second and third rows of outdoor unit coils operating as a condenser, thereby providing high condensing effects and improving the performance in the cooling operation of the heat pump.

It is yet another object of the present invention to provide an alternating type heat pump that has first to third rows of outdoor unit coils all operated as an evaporator during the heating operation of the heat pump, thereby optimizing the evaporating capability, and that makes use of the first row of outdoor unit coil as a condenser, if an outdoor air temperature is lowered in the coldest weather and a temperature difference between the outdoor air temperature and refrigerant is decreased to drastically reduce the evaporating capability of the outdoor unit coils, such that the heated air through the first row of outdoor unit coil is introduced gently to the second and third rows of outdoor unit coils operating as an evaporator, thereby providing high evaporating effects and improving the performance in the heating operation of the heat pump.

Solution to Problem

To accomplish the above objects, according to a first aspect of the present invention, there is provided an alternating type heat pump having a compressor adapted to compress refrigerant, an accumulator adapted to keep liquid refrigerant from flowing to the compressor, a four-way valve adapted to allow the flow direction of the refrigerant passed through the compressor to be changed to a heating or cooling circuit, an indoor unit adapted to perform a heat exchanging operation between indoor air and the refrigerant, an outdoor unit adapted to perform a heat exchanging operation between outdoor air and the refrigerant, expansion valves adapted to reduce refrigerant temperature and pressure in accordance with a heating or cooling operation, and check valves disposed in parallel with the expansion valves and adapted to control the flow direction of the refrigerant in one way, the heat pump including: three or more rows of outdoor unit coils disposed in the outdoor unit; and a plurality of three-way valves disposed on at least one of the front and rear ends of the three or more rows of outdoor unit coils and adapted to change the flow direction of the refrigerant, such that the three or more rows of outdoor unit coils are selectively operated as a condenser or evaporator in accordance with the load conditions and outdoor air conditions.

To accomplish the above objects, according to a second aspect of the present invention, there is provided an alternating type heat pump including: a compressor adapted to compress refrigerant; an accumulator adapted to keep liquid refrigerant from flowing to the compressor; a four-way valve adapted to allow the flow direction of the refrigerant passed through the compressor to be changed to a heating or cooling circuit; an indoor unit adapted to perform a heat exchanging operation between indoor air and the refrigerant; an outdoor unit adapted to perform a heat exchanging operation between outdoor air and the refrigerant and having first to third rows of outdoor unit coils disposed side by side; heating and cooling expansion valves adapted to reduce refrigerant temperature and pressure in accordance with a heating or cooling operation; first and second check valves disposed in parallel with the heating and cooling expansion valves and adapted to control the flow direction of the refrigerant in one way; and first to sixth three-way valves adapted to change the flow direction of the refrigerant and to allow the first to third rows of outdoor unit coils to be selectively operated as a condenser or evaporator in accordance with the load conditions and outdoor air conditions, the fourth and first three-way valves being disposed on the front and rear ends of the first row of outdoor unit coil, the fifth and second three-way valves being disposed on the front and rear ends of the second row of outdoor unit coil, and the sixth and third three-way valves being disposed on the front and rear ends of the third row of outdoor unit coil.

To accomplish the above objects, according to a third aspect of the present invention, there is provided an alternating type heat pump including: a compressor adapted to compress refrigerant; an accumulator adapted to keep liquid refrigerant from flowing to the compressor; a four-way valve adapted to allow the flow direction of the refrigerant passed through the compressor to be changed to a heating or cooling circuit; an indoor unit adapted to perform a heat exchanging operation between indoor air and the refrigerant; an outdoor unit adapted to perform a heat exchanging operation between outdoor air and the refrigerant and having first to third rows of outdoor unit coils disposed side by side; heating and cooling expansion valves adapted to reduce refrigerant temperature and pressure in accordance with a heating or cooling operation first and second check valves disposed in parallel with the heating and cooling expansion valves and adapted to control the flow direction of the refrigerant in one way; first to fourth three-way valves disposed on the front ends of the first to third rows of outdoor unit coils and on the rear end of the row of outdoor unit coil being first to be brought into contact with outside air in the first to third rows of outdoor unit coils; a controller adapted to control the first to fourth three-way valves such that the flow direction of the refrigerant is changed to allow at least one of the first to third rows of outdoor unit coils to be selectively operated as a condenser or evaporator in accordance with the load conditions and outdoor air conditions; and a bypass valve adapted to measure the refrigerant emitted from the four-way valve to send a portion of the refrigerant to the front end side of the outdoor unit and to send the rest to the indoor unit side.

Advantageous Effects of Invention

As described above, the heat pump according to the present invention has the following effects in accordance with the operating methods of the outdoor unit coils.

First, when the heat pump is operated in a cooling mode in a summer season, the first to third rows of outdoor unit coils are all operated as a condenser, thereby enhancing the cooling performance of the heat pump through the improvement of the condensing capability, and if an outdoor air temperature is raised at the time of the cooling operation to decrease the condensing capability of the outdoor unit coils, the first row of outdoor unit coil is operated as an evaporator, thereby enhancing the cooling performance of the heat pump through the improvement of the condensing capability.

Second, when the heat pump is operated in a heating mode in a winter season, the first to third rows of outdoor unit coils are all operated as an evaporator, thereby enhancing the heating performance of the heat pump through the improvement of the evaporating capability, and if an outdoor air temperature is lowered at the time of the heating operation to decrease the evaporating capability of the outdoor unit coils, the first row of outdoor unit coil is operated as a condenser, thereby enhancing the heating performance of the heat pump through the improvement of the evaporating capability.

Third, under the outdoor air conditions where frost is easily formed, the first, second or third row of outdoor unit coils on which the frost is formed in the greatest amount in the first to third rows of outdoor unit coils is selected and operated as a condenser, and otherwise, the first to third rows of outdoor unit coils are sequentially and selectively operated as a condenser with a given period of time, thereby perfectly preventing the frost from being formed or growing and further avoiding the stop of the heating operation caused by the formation of the frost to provide continuous heating.

DETAILED DESCRIPTION

Best Mode for Carrying Out the Invention

According to the present invention, there is provided an alternating type heat pump including: a compressor adapted to compress refrigerant; an accumulator adapted to keep liquid refrigerant from flowing to the compressor; a four-way valve adapted to allow the flow direction of the refrigerant passed through the compressor to be changed to a heating or cooling circuit; an indoor unit adapted to perform a heat exchanging operation between indoor air and the refrigerant; an outdoor unit adapted to perform a heat exchanging operation between outdoor air and the refrigerant and having first to third rows of outdoor unit coils disposed side by side; heating and cooling expansion valves adapted to reduce refrigerant temperature and pressure in accordance with a heating or cooling operation first and second check valves disposed in parallel with the heating and cooling expansion valves and adapted to control the flow direction of the refrigerant in one way; first to fourth three-way valves disposed on the front ends of the first to third rows of outdoor unit coils and on the rear end of the row of outdoor unit coil being first to be brought into contact with outside air in the first to third rows of outdoor unit coils; a controller adapted to control the first to fourth three-way valves such that the flow direction of the refrigerant is changed to allow at least one of the first to third rows of outdoor unit coils to be selectively operated as a condenser or evaporator in accordance with the load conditions and outdoor air conditions; and a bypass valve adapted to measure the refrigerant emitted from the four-way valve to send a portion of the refrigerant to the front end side of the outdoor unit and to send the rest to the indoor unit side.

Mode for the Invention

Hereinafter, an explanation on a configuration, operation, and operating method of an alternating type heat pump according to a first embodiment of the present invention will be in detail given with reference to the attached drawings.

Figure 1:
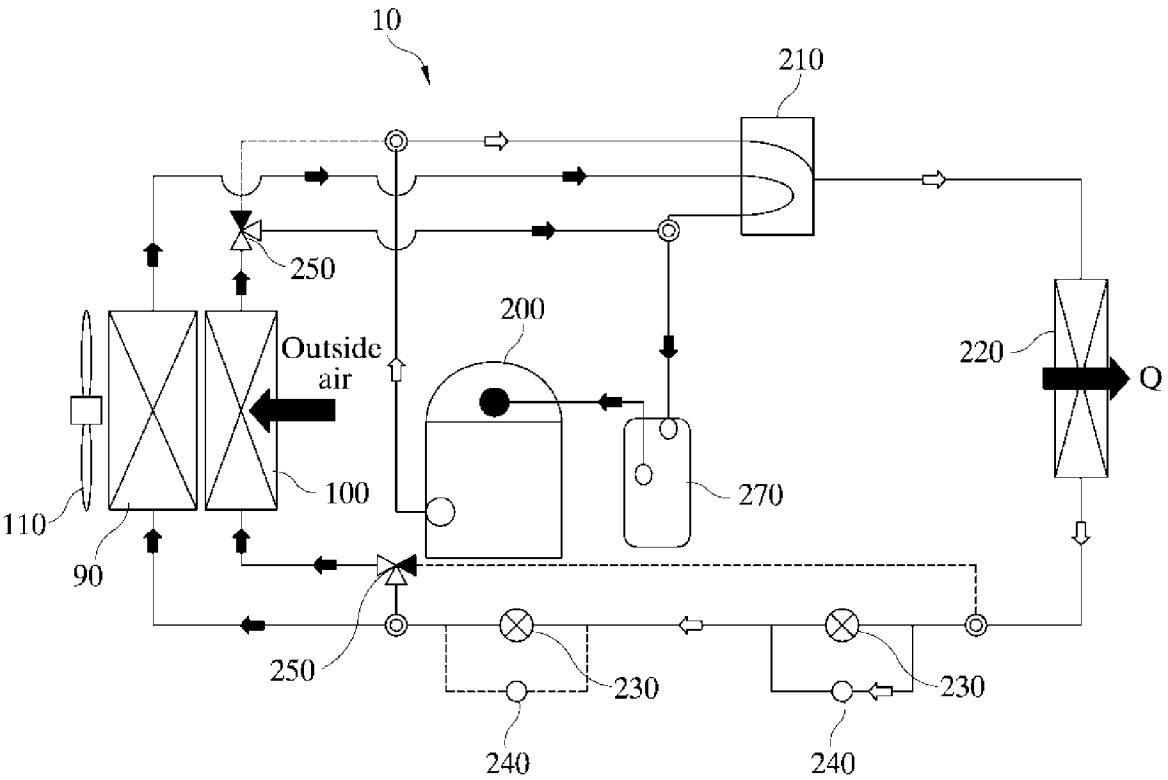
FIG. 1 is a schematic circuit diagram showing a standard heating operation in a heat pump according to a conventional practice.
Figure 2:
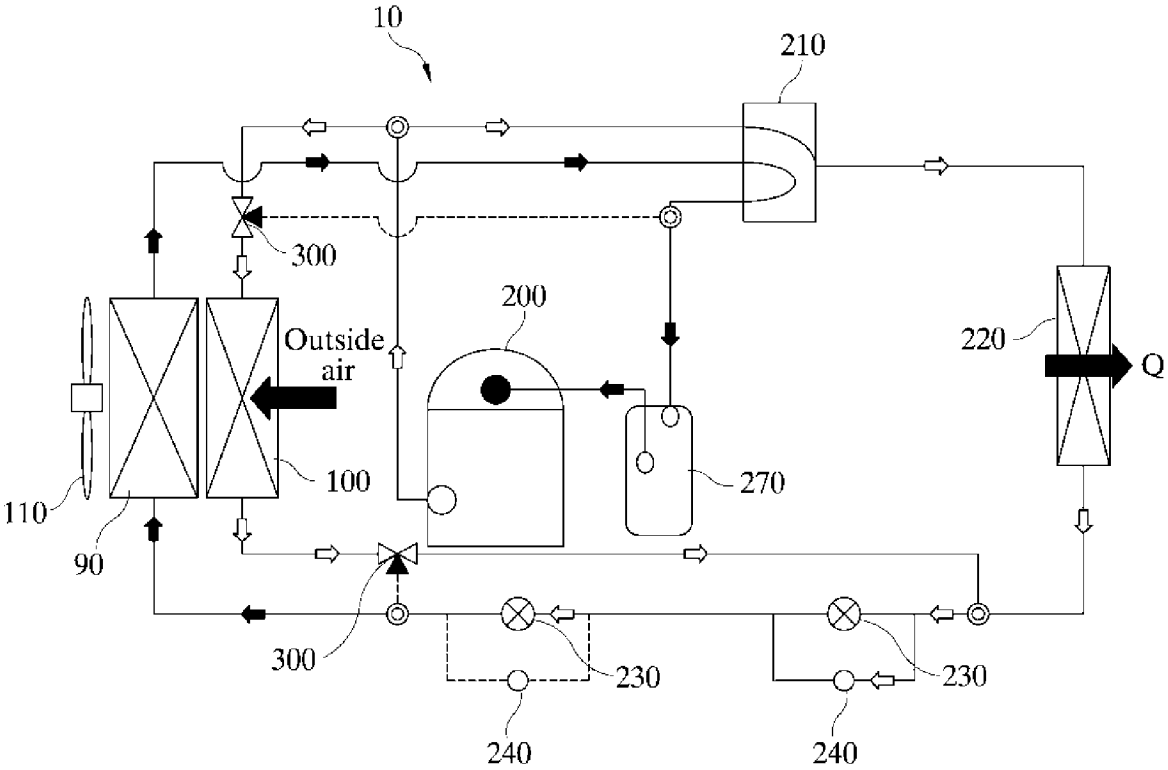
FIG. 2 is a schematic circuit diagram showing defrosting and heating operations in the heat pump according to the conventional practice.
Figure 3:
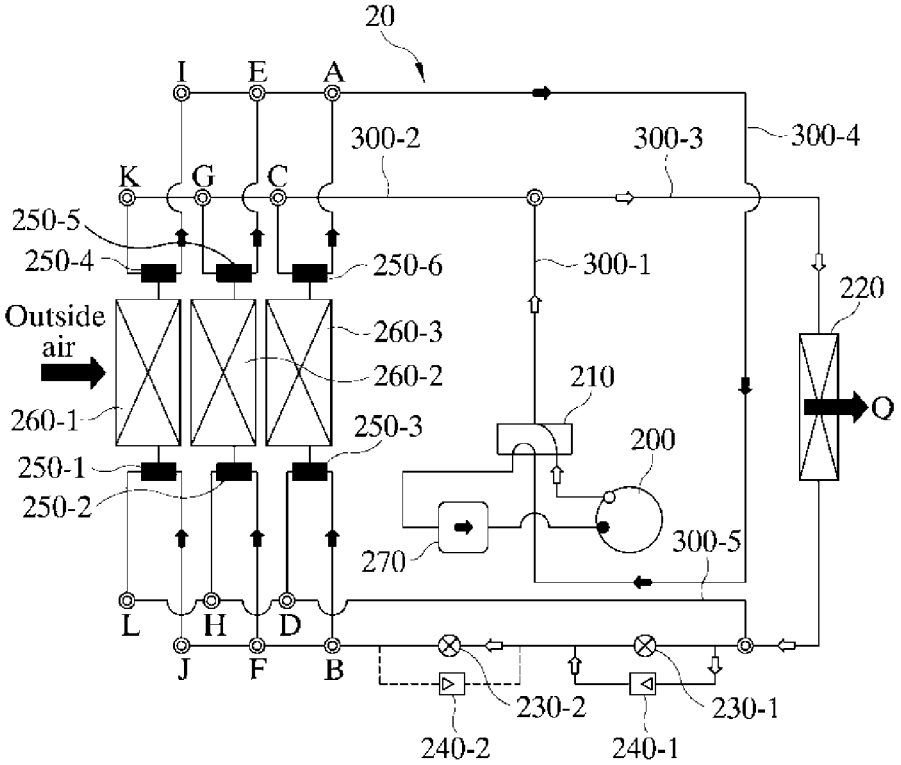
FIG. 3 is a schematic circuit diagram showing a standard heating operation in an alternating type heat pump according to a first embodiment of the present invention.

FIG. 3 is a schematic circuit diagram showing a standard heating operation in an alternating type heat pump according to a first embodiment of the present invention.

As shown in FIG. 3, so as to optimize an evaporating capability under the outdoor air conditions where no frost is formed, all of first to third rows of outdoor unit coils 260-1 to 260-3 are operated as an evaporator. Accordingly, first to sixth three-way valves 250-1 to 250-6 are controlled such that refrigerant does not flow toward lines K-L, G-H and C-D and at the same time it flows toward lines I-J, E-F and A-B. Thus, the first to third rows of outdoor unit coils 260-1 to 260-3 are operated as the evaporator, thereby optimizing the evaporating capability and improving the heating performance.

Figure 4:
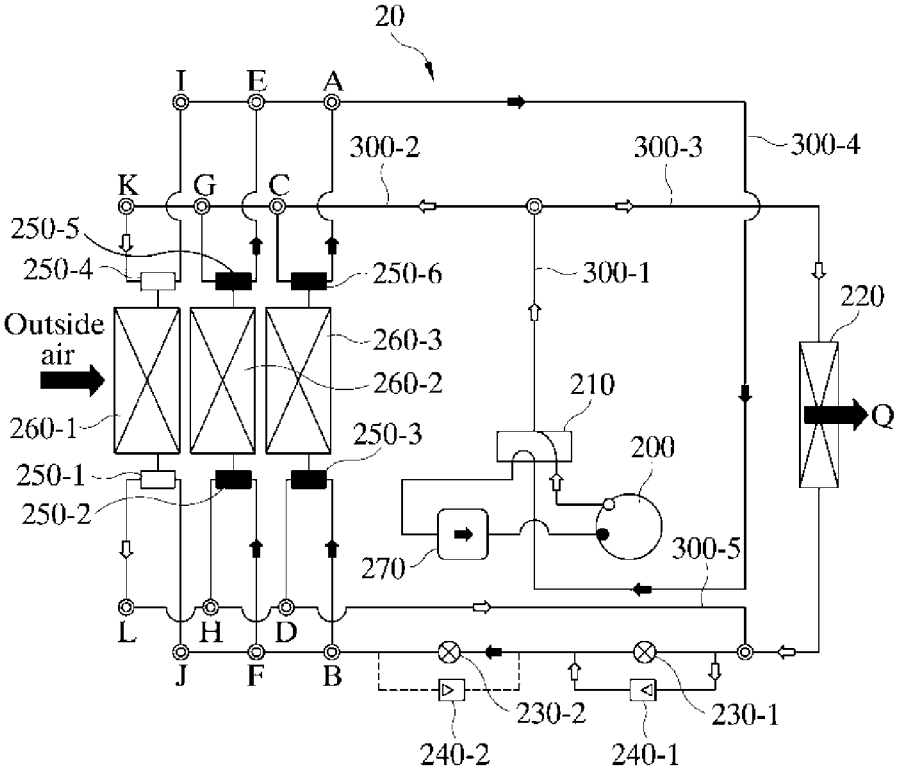
FIG. 4 is a schematic circuit diagram showing the alternating type heat pump according to the first embodiment of the present invention, wherein a first row of outdoor unit coil is operated as a condenser to perform defrosting and heating operations.

FIG. 4 is a schematic circuit diagram showing the alternating type heat pump according to the first embodiment of the present invention, wherein the first row of outdoor unit coil 260-1 is operated as a condenser to perform defrosting and heating operations. As shown in FIG. 4, the high temperature and high pressure gas refrigerant emitted from a compressor 200 is passed through a four-way valve 210 and a first pipe 300-1, such that a portion of the refrigerant is sent to the first row of outdoor unit coil 260-1 via a second pipe 300-2 and the rest is sent to an indoor unit 220 via a third pipe 300-3. Accordingly, the first row of outdoor unit coil 260-1 is operated as a condenser, thereby allowing the outdoor air to be heated. The heated air is passed through the second and third rows of outdoor unit coils 260-2 and 260-3 operated as an evaporator, thereby improving the evaporating capability and at the same time suppressing and delaying the formation of the frost.

At this time, the first and fourth three-way valve 250-1 and 250-4 are opened to allow the high temperature and high pressure refrigerant to flow toward the first row of outdoor unit coil 260-1 along the line K-L, and the second and fifth three-way valve 250-2 and 250-5 and the third and sixth three-way valves 250-3 and 250-6 are closed to keep the high temperature and high pressure refrigerant from flowing toward the second and third rows of outdoor unit coils 260-2 and 260-3 along the respective lines G-H and C-D. The refrigerant condensed while being passed through the first row of outdoor unit coil 260-1 is added to the refrigerant condensed while being passed through the indoor unit 220 and is then passed through a first check valve 240-1 and a heating expansion valve 230-2, such that a portion of the refrigerant flows along a point F, the second three-way valve 250-2, the second row of outdoor unit coil 260-2, the fifth three-way valve 250-5 and a point E, and the rest thereof flows along a point B, the third three-way valve 250-3, the third row of outdoor unit coil 260-3, the sixth three-way valve 250-6 and a point A. Then, the refrigerant is evaporated and absorbed to the compressor 200 via a fourth pipe 300-4 and an accumulator 270, thereby completing a heating cycle.

Figure 5:
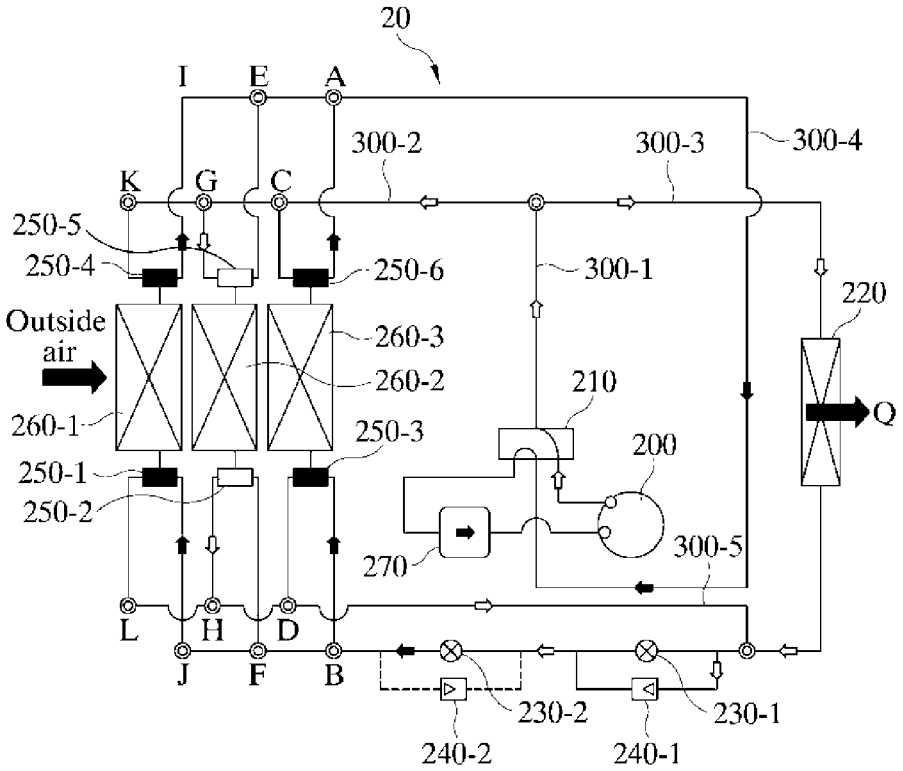
FIG. 5 is a schematic circuit diagram showing the alternating type heat pump according to the first embodiment of the present invention, wherein a second row of outdoor unit coil is operated as a condenser to perform defrosting and heating operations.

FIG. 5 is a schematic circuit diagram showing the alternating type heat pump according to the first embodiment of the present invention, wherein the second row of outdoor unit coil 260-2 is operated as a condenser to perform defrosting and heating operations. In the heating operation like FIG. 4, because of various reasons (that is, when a large amount of water is accumulated on the outdoor unit coils before the heat pump is operated for heating, or when the refrigerant is not appropriately distributed to the first row of outdoor unit coil operated as a condenser), if the first row of outdoor unit coil 260-1 operated as the condenser does not heat the outdoor air to the degree necessary to prevent the formation of the frost on the second and third rows of outdoor unit coils 260-2 and 260-3 operated as the evaporator or does not remove the frost formed already thereon, the frost formed on the second and third rows of outdoor unit coils 260-2 and 260-3 operated as the evaporator becomes increased in quantity as the heating operation of the heat pump is kept, such that the evaporating capability is lost to make it impossible to operate the heat pump. In this case, therefore, as shown in FIG. 5, the lines K-L, E-F and C-D are turned off and the lines I-J and A-B are turned on such that the high temperature and high pressure refrigerant emitted from the compressor 200 flows along the line G-H to operate the second row of outdoor unit coil 260-2 as a condenser, thereby removing the frost formed on the second and third rows of outdoor unit coils 260-2 and 260-3.

Figure 6:
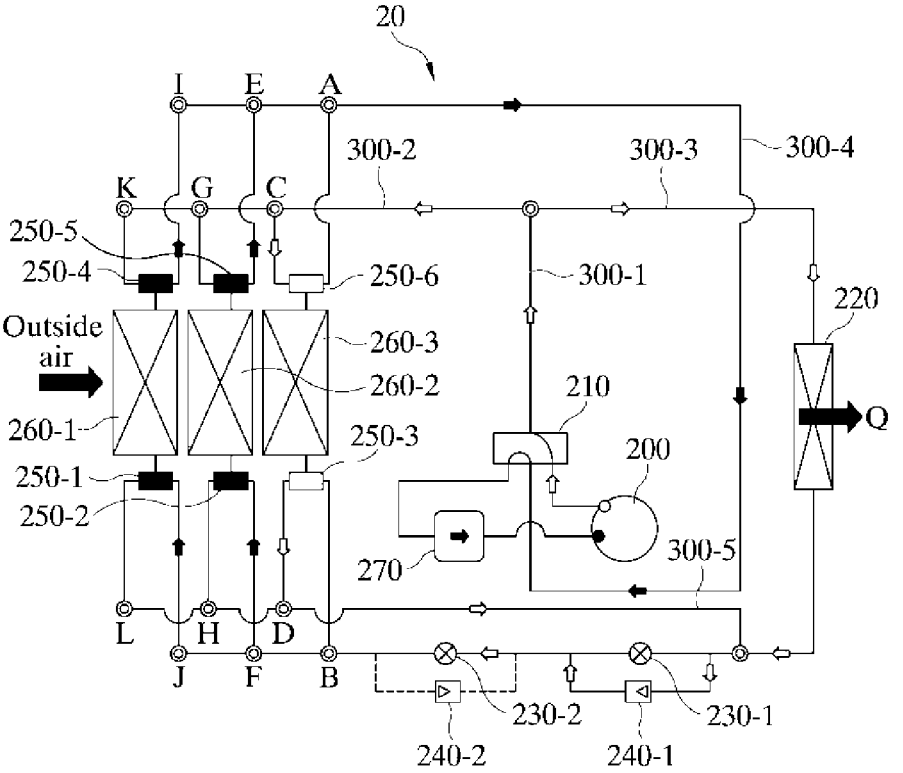
FIG. 6 is a schematic circuit diagram showing the alternating type heat pump according to the first embodiment of the present invention, wherein a third row of outdoor unit coil is operated as a condenser to perform defrosting and heating operations.

FIG. 6 is a schematic circuit diagram showing the alternating type heat pump according to the first embodiment of the present invention, wherein the third row of outdoor unit coil 260-3 is operated as a condenser to perform defrosting and heating operations. If frost is formed on the third row of outdoor unit coil 260-3 even when the first and second rows of outdoor unit coils 260-1 and 260-2 are operated as the condenser as shown in FIGS. 4 and 5, the lines K-L, G-H and A-B are turned off and the lines I-J and E-F are turned on such that the high temperature and high pressure refrigerant emitted from the compressor 200 flows along the line C-D to operate the third row of outdoor unit coil 260-3 as a condenser, thereby removing the frost formed thereon.

Only the outdoor unit coils on which the formation of the frost is sensed by means of frosting condition sensors (not shown) mounted on the respective rows of outdoor unit coils are selectively operated as a condenser to prevent the formation of the frost on the outdoor unit coils, and otherwise, the operating methods as shown in FIGS. 4 to 6 are sequentially carried out at given time intervals to operate the respective rows of outdoor unit coils as a condenser, thereby basically preventing the formation of the frost on the outdoor unit.

On the other hand, frosting sensors (not shown) are mounted at one end or both ends of the respective rows of outdoor unit coils so as to sense the outdoor unit coils to which defrosting is necessary or frosting may occur, and a controller (not shown) is disposed on the heat pump so as to electronically open and close the three-way valves mounted at both ends of the respective rows of outdoor unit coils in accordance with the sensed signals from the frosting sensors. Such sensors and controller are formed of known sensors and circuits, and they may be formed having various shapes in accordance with the installation environments of the heat pump.

Figure 7:
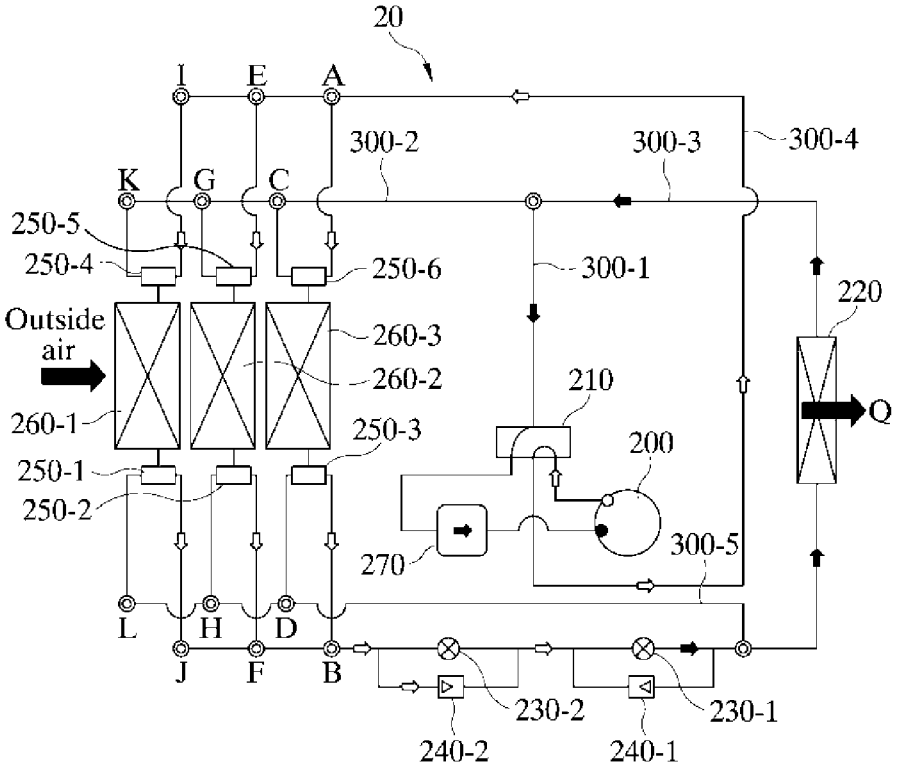
FIG. 7 is a schematic circuit diagram showing a standard cooling operation in the alternating type heat pump according to the first embodiment of the present invention.

FIG. 7 is a schematic circuit diagram showing a standard cooling operation in the alternating type heat pump according to the first embodiment of the present invention. As shown in FIG. 7, the high temperature and high pressure gas refrigerant emitted from the compressor 200 is sent to the first to third rows of outdoor unit coils 260-1 to 260-3 via the four-way valve 210 and the fourth pipe 300-4 and is then condensed thereon. At this time, the first to sixth three-way valves 250-1 to 250-6 are controlled such that the high temperature and high pressure refrigerant flows toward the lines I-J, E-F and A-B and at the same time it does not flow toward lines K-L, G-H and C-D. Thus, the refrigerant condensed while being passed through the first to third rows of outdoor unit coils 260-1 to 260-3 is passed through a second check valve 240-2 and a cooling expansion valve 230-1 and is sent to the indoor unit 220. As the refrigerant is evaporated in the indoor unit 220, the indoor air is absorbed to allow the indoor space to be cooled. The refrigerant evaporated in the indoor unit 220 is passed sequentially through the third pipe 300-3, the first pipe 300-1, the four-way valve 210 and the accumulator 270 and is then absorbed to the compressor 200, thereby completing a cooling cycle.

Figure 8:
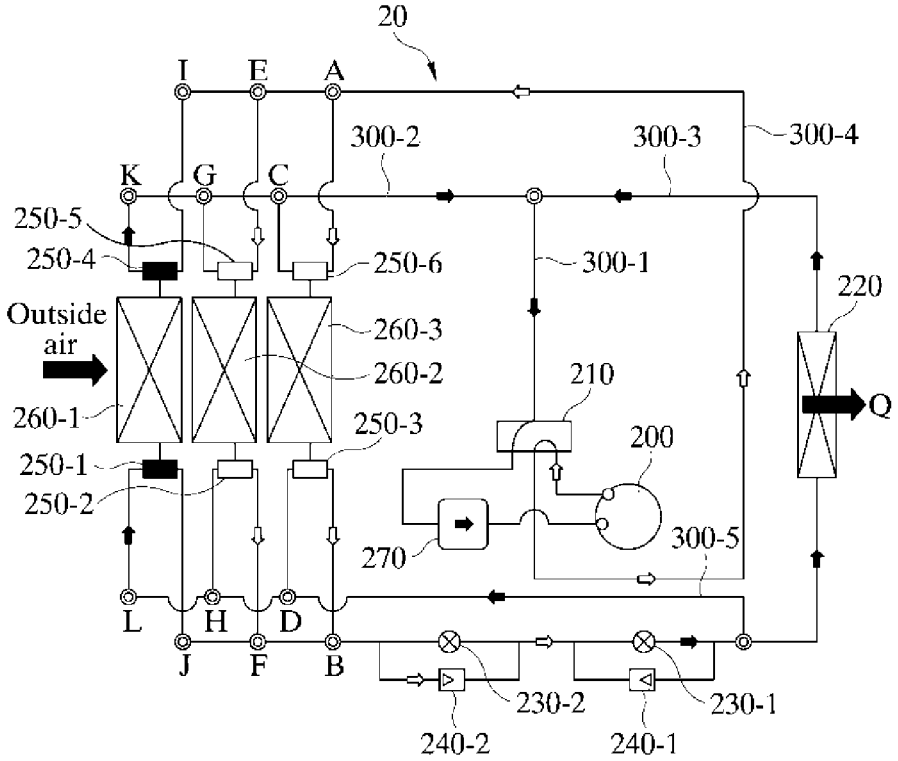
FIG. 8 is a schematic circuit diagram showing the alternating type heat pump according to the first embodiment of the present invention, wherein the first row of outdoor unit coil is operated as an evaporator to perform a cooling operation.

FIG. 8 is a schematic circuit diagram showing the alternating type heat pump according to the first embodiment of the present invention, wherein the first row of outdoor unit coil 260-1 is operated as an evaporator to perform a cooling operation. As shown in FIG. 8, the high temperature and high pressure gas refrigerant emitted from the compressor 200 is sent to the second and third rows of outdoor unit coils 260-2 and 260-3 via the four-way valve 210 and the fourth pipe 300-4 and is then condensed thereon. At this time, the first to sixth three-way valves 250-1 to 250-6 are controlled such that the high temperature and high pressure refrigerant flows toward the lines E-F and A-B and at the same time it does not flow toward the line I-J. The refrigerant condensed while being passed through the second and third rows of outdoor unit coils 260-2 and 260-3 is passed through the second check valve 240-2 and the cooling expansion valve 230-1, such that a portion of the refrigerant flows along a point L, the first three-way valve 250-1, the first row of outdoor unit coil 260-1, the fourth three-way valve 250-4 and a point K, and the rest thereof is sent to the indoor unit 220. The refrigerant flowing along the line L-K is evaporated in the first row of outdoor unit coil 260-1 and is heat-exchanged with the outdoor air, thereby allowing the outdoor air temperature to be dropped. The cooled air is passed through the second and third rows of outdoor unit coils 260-2 and 260-3, thereby improving the condensing effects. The refrigerant evaporated while being passed through the indoor unit 220 and the refrigerant evaporated while flowing along the line L-K are added and absorbed to the compressor 220 via the first pipe 300-1, the four-way valve 210 and the accumulator 270, sequentially, thereby completing the cooling cycle.

Hereinafter, an explanation on a configuration, operation, and operating method of an alternating type heat pump according to a second embodiment of the present invention will be in detail given with reference to the attached drawings. The second embodiment of the present invention is different from the first embodiment of the present invention in that only four three-way valves and one bypass valve are provided.

Figure 9:
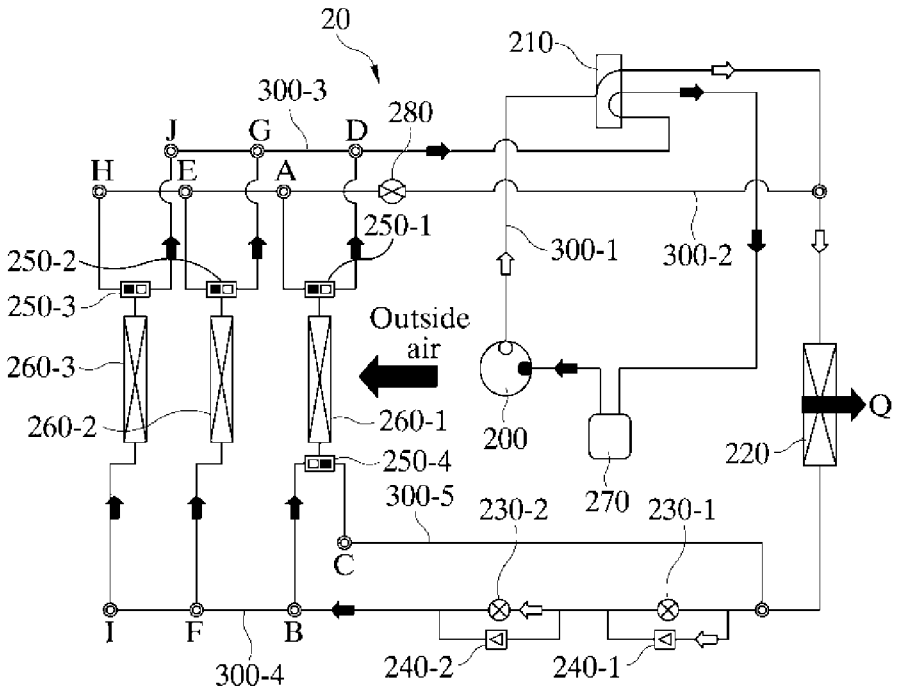
FIG. 9 is a schematic circuit diagram showing a standard heating operation in an alternating type heat pump according to a second embodiment of the present invention.

FIG. 9 is a schematic circuit diagram showing a standard heating operation in an alternating type heat pump according to a second embodiment of the present invention. As shown in FIG. 9, the alternating type heat pump according to the second embodiment of the present invention includes an outdoor unit composed of first to third rows of outdoor unit coils 260-1 to 260-3, a compressor 200, a bypass valve 280, a four-way valve 210, an indoor unit 220, and first to fourth three-way valves 250-1 to 250-5.

As shown in FIG. 9, so as to optimize the evaporating capability in case where no frost is formed, the first to third rows of outdoor unit coils 260-1 to 260-3 are all operated as an evaporator. Therefore, the first to fourth three-way valves 250-1 to 250-5 are controlled by means of a controller (not shown) to allow all of the first to third rows of outdoor unit coils 260-1 to 260-3 to be operated as an evaporator (that is, so as to operate the first to third rows of outdoor unit coils 260-1 to 260-3 as an evaporator, the first to fourth three-way valves 250-1 to 250-4 are controlled by means of the controller, such that the condensed refrigerant is introduced and evaporated to the rear ends of the respective rows of outdoor unit coils and then emitted to the front ends thereof, that is, along lines B-D, F-G and I-J). The condensed refrigerant through the indoor unit 220 is passed through a first check valve 240-1 and a heating expansion valve 230-2 and is then passed through the fourth three-way valve 350-4, such that a portion of the refrigerant is sent to the first row of outdoor unit coil 260-1, and the rest is sent to the second and third rows of outdoor unit coils 260-2 and 260-3, thereby optimizing the evaporating capability and improving heating performance.

Figure 10:
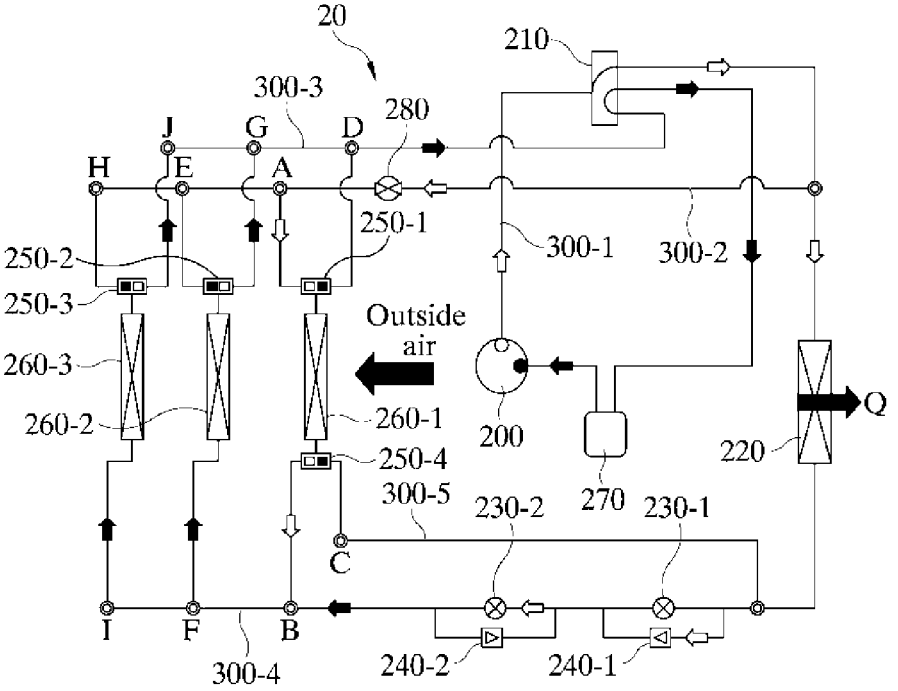
FIG. 10 is a schematic circuit diagram showing the alternating type heat pump according to the second embodiment of the present invention, wherein a first row of outdoor unit coil is operated as a condenser to perform defrosting and heating operations.

FIG. 10 is a schematic circuit diagram showing the alternating type heat pump according to the second embodiment of the present invention, wherein the first row of outdoor unit coil 260-2 is operated as a condenser to perform defrosting and heating operations. As shown in FIG. 10, the high temperature and high pressure gas refrigerant emitted from the compressor 200 is passed through a first pipe 300-1 and the four-way valve 210. After that, a portion of the refrigerant measured by the bypass valve 280 is sent to the first row of outdoor unit coil 260-1 via a second pipe 300-2 and the first three-way valve 250-1, and the rest is sent to the indoor unit 220.

Accordingly, the first row of outdoor unit coil 260-1 is operated as a condenser to heat the outdoor air, and at the same time, if frost is formed on the surface of the first row of outdoor unit coil 260-1, the first row of outdoor unit coil 260-1 removes the frost or continuously prevents the frosting thereon. The heated air is passed through the second and third rows of outdoor unit coils 260-2 and 260-3 operated as an evaporator, thereby improving the evaporating capability and suppressing and delaying the formation of the frost on the second and third rows of outdoor unit coils 260-2 and 260-3.

So as to operate the first row of outdoor unit coil 260-1 as a condenser, at this time, the first and fourth three-way valves 250-1 and 250-4 are opened by means of the controller to allow the high temperature and high pressure refrigerant to flow toward the front end of the first row of outdoor unit coil 260-1 (which is opened forwardly along the line A-B). Also, the second and third three-way valve 250-2 and 250-3 and the third and sixth three-way valves 250-3 and 250-6 are closed by means of the controller to keep the high temperature and high pressure refrigerant from flowing toward the second and third rows of outdoor unit coils 260-2 and 260-3 (which is opened reversely).

The refrigerant condensed while being passed through the first row of outdoor unit coil 260-1 is added to the refrigerant condensed while being passed through the indoor unit 220 on a fourth pipe 300-4 disposed on the rear end of a heating expansion valve 230-2 (at a point B as shown in FIG. 10) and is introduced and evaporated to the second and third rows of outdoor unit coils 260-2 and 260-3 operated as an evaporator. Next, the refrigerant is absorbed to the compressor 200 via a third pipe 300-3, the four-way valve 210 and an accumulator 270, sequentially, thereby completing a defrosting heating cycle.

Figure 11:
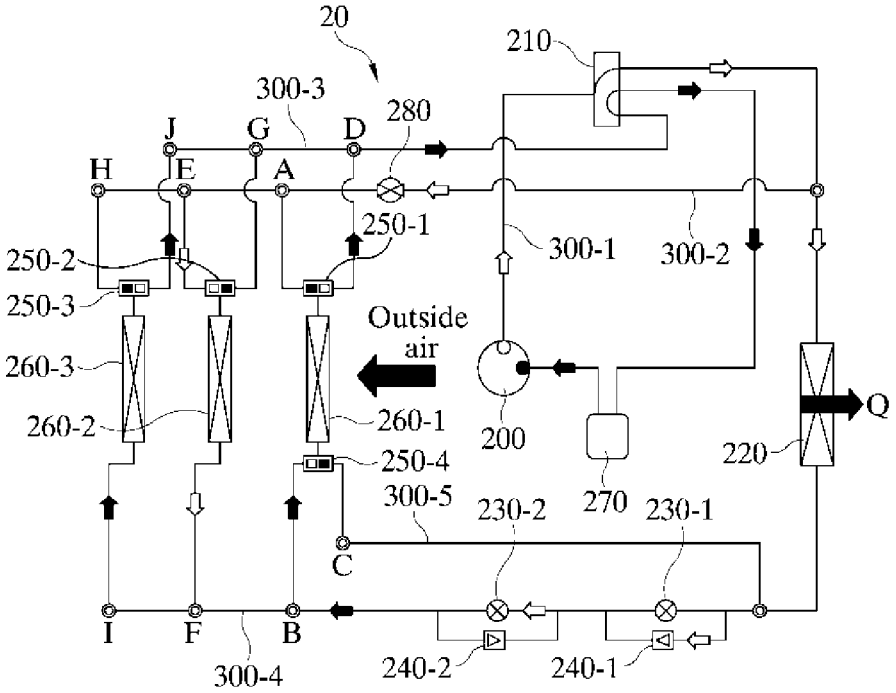
FIG. 11 is a schematic circuit diagram showing the alternating type heat pump according to the second embodiment of the present invention, wherein a second row of outdoor unit coil is operated as a condenser to perform defrosting and heating operation.

FIG. 11 is a schematic circuit diagram showing the alternating type heat pump according to the second embodiment of the present invention, wherein the second row of outdoor unit coil 260-2 is operated as a condenser to perform defrosting and heating operations. As shown in FIG. 11, the high temperature and high pressure gas refrigerant emitted from the compressor 200 is passed through the first pipe 300-1 and the four-way valve 210. After that, a portion of the refrigerant measured by the bypass valve 280 is sent to the second row of outdoor unit coil 260-2 via the second pipe 300-2 and the second three-way valve 250-2, and the rest is sent to the indoor unit 220.

Accordingly, the second row of outdoor unit coil 260-2 is operated as a condenser to heat the outdoor air, and at the same time, if frost is formed on the surface of the second row of outdoor unit coil 260-2, the second row of outdoor unit coil 260-2 removes the frost or continuously prevents the frosting thereon. The heated air is passed through the third row of outdoor unit coil 260-3 operated as an evaporator, thereby improving the evaporating capability and suppressing and delaying the formation of the frost on the third row of outdoor unit coil 260-2.

So as to operate the second row of outdoor unit coil 260-2 as a condenser, at this time, the second three-way valve 250-2 is opened by means of the controller in a forward direction (along the line E-F) such that the high temperature and high pressure refrigerant is introduced to the front end of the second row of outdoor unit coil 260-2 and is emitted to the rear end thereof. Also, the first and third three-way valve 250-1 and 250-3 are closed by means of the controller to keep the high temperature and high pressure refrigerant from flowing toward the first and third rows of outdoor unit coils 260-1 and 260-3.

The refrigerant condensed while passing through the second row of outdoor unit coil 260-2 is added to the refrigerant condensed while passing through the indoor unit 220 on the fourth pipe 300-4 disposed on the rear end of the heating expansion valve 230-2 (at the point B as shown in FIG. 11) and is introduced and evaporated to the first and third rows of outdoor unit coils 260-1 and 260-3 operated as an evaporator. Next, the refrigerant is absorbed to the compressor 200 via the third pipe 300-3, the four-way valve 210 and an accumulator 270, thereby completing a defrosting heating cycle.

Figure 12:
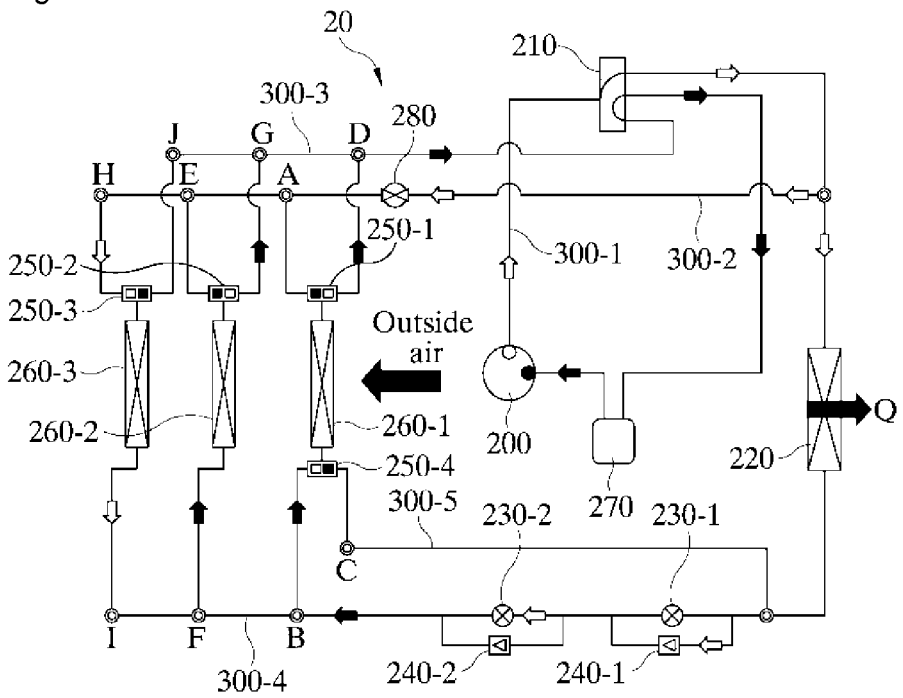
FIG. 12 is a schematic circuit diagram showing the alternating type heat pump according to the second embodiment of the present invention, wherein a third row of outdoor unit coil is operated as a condenser to perform defrosting and heating operations.

FIG. 12 is a schematic circuit diagram showing the alternating type heat pump according to the second embodiment of the present invention, wherein the third row of outdoor unit coil 260-3 is operated as a condenser to perform defrosting and heating operations. As shown in FIG. 12, the high temperature and high pressure gas refrigerant emitted from the compressor 200 is passed through the first pipe 300-1 and the four-way valve 210. After that, a portion of the refrigerant measured by the bypass valve 280 is sent to the third row of outdoor unit coil 260-3 via the second pipe 300-2 and the third three-way valve 250-3, and the rest is sent to the indoor unit 220.

Accordingly, the third row of outdoor unit coil 260-3 is operated as a condenser, and if frost is formed on the surface of the third row of outdoor unit coil 260-3, the third row of outdoor unit coil 260-3 removes the frost or continuously prevents the frosting thereon.

So as to operate the third row of outdoor unit coil 260-3 as a condenser, at this time, the third three-way valve 250-3 is opened by means of the controller in a forward direction (along the line H-I) such that the high temperature and high pressure refrigerant is introduced to the front end of the third row of outdoor unit coil 260-3 and is emitted to the rear end thereof. Also, the first and second three-way valve 250-1 and 250-2 are closed by means of the controller to keep the high temperature and high pressure refrigerant from flowing toward the first and second rows of outdoor unit coils 260-1 and 260-2.

The refrigerant condensed while being passed through the third row of outdoor unit coil 260-3 is added to the refrigerant condensed while being passed through the indoor unit 220 on the fourth pipe 300-4 disposed on the rear end of the heating expansion valve 230-2 and is introduced and evaporated to the rear ends of the first and second rows of outdoor unit coils 260-1 and 260-2 operated as an evaporator. Next, the refrigerant is absorbed to the compressor 200 via the third pipe 300-3, the four-way valve 210 and an accumulator 270, thereby completing a defrosting heating cycle.

Only the outdoor unit coils on which the formation of the frost is sensed by means of frosting condition sensors (not shown) mounted on the respective rows of outdoor unit coils are selectively operated as a condenser to prevent the formation of the frost on the outdoor unit coils, and otherwise, the operating methods as shown in FIGS. 10 to 12 are sequentially carried out at given time intervals to operate the respective rows of outdoor unit coils as the condenser, thereby basically preventing the formation of the frost on the outdoor unit coils. That is, if the frosting is sensed by means of the frosting condition sensors, the sensed signal is sent to the controller, and the three-way valve disposed on the row of outdoor unit coil on which the frost occurs is controlled by means of the controller, thereby operating the corresponding row of outdoor unit coil as a condenser. Also, the bypass valve is controlled to allow an appropriate refrigerant flow to flow to the corresponding row of outdoor unit coil.

Figure 13:
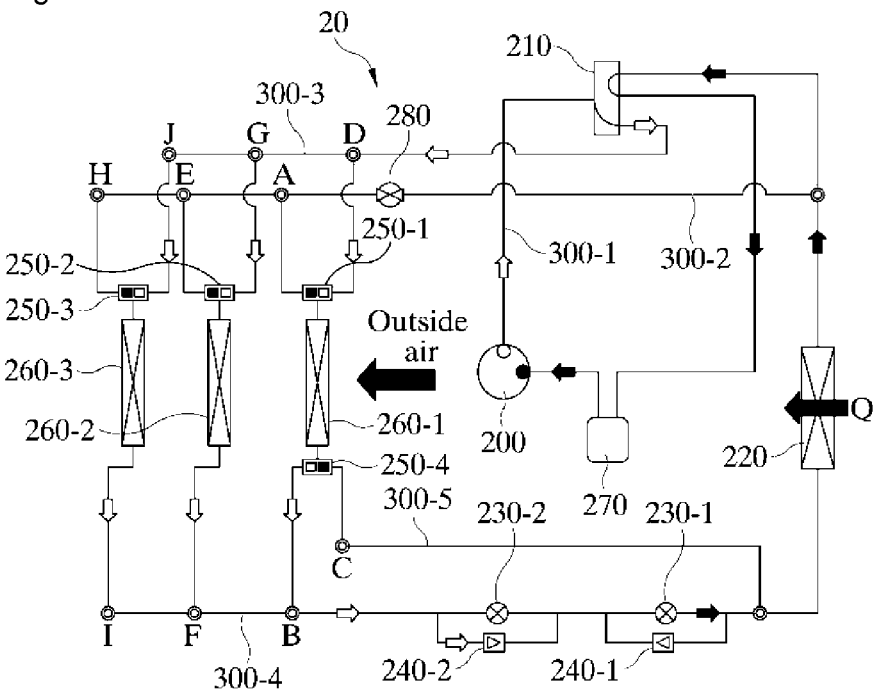
FIG. 13 is a schematic circuit diagram showing a standard cooling operation in the alternating type heat pump according to the second embodiment of the present invention.

FIG. 13 is a schematic circuit diagram showing a standard cooling operation in the alternating type heat pump according to the second embodiment of the present invention. As shown in FIG. 13, the high temperature and high pressure gas refrigerant emitted from the compressor 200 is distributed on the third pipe 300-3 via the four-way valve 210 and is then sent to the first to third rows of outdoor unit coils 260-1 to 260-3 via the respective first to third three-way valves 250-1 to 250-3. After that, the refrigerant is condensed thereon. That is, in case of a standard cooling operation, all of the first to third rows of outdoor unit coils 260-1 to 260-3 are operated as a condenser, thereby optimizing the cooling capability.

So as to allow the high temperature and high pressure gas refrigerant to flow toward all of first to third rows of outdoor unit coils 260-1 to 260-3, at this time, the first to fourth three-way valves 250-1 to 250-4 are opened by means of the controller in a forward direction (along the lines D-B, G-F and J-I). The refrigerant condensed while being passed through the first to third rows of outdoor unit coils 260-1 to 260-3 is added on the fourth pipe 300-4 and is sent to the indoor unit 220 via the second check valve 240-2 and the cooling expansion valve 230-1. As the refrigerant is evaporated in the indoor unit 220, heat from the indoor air is absorbed thereto to allow the indoor space to be cooled. The refrigerant evaporated in the indoor unit 220 is passed through the four-way valve 210 and the accumulator 270 and is then absorbed to the compressor 200, thereby completing a cooling cycle.

Figure 14:
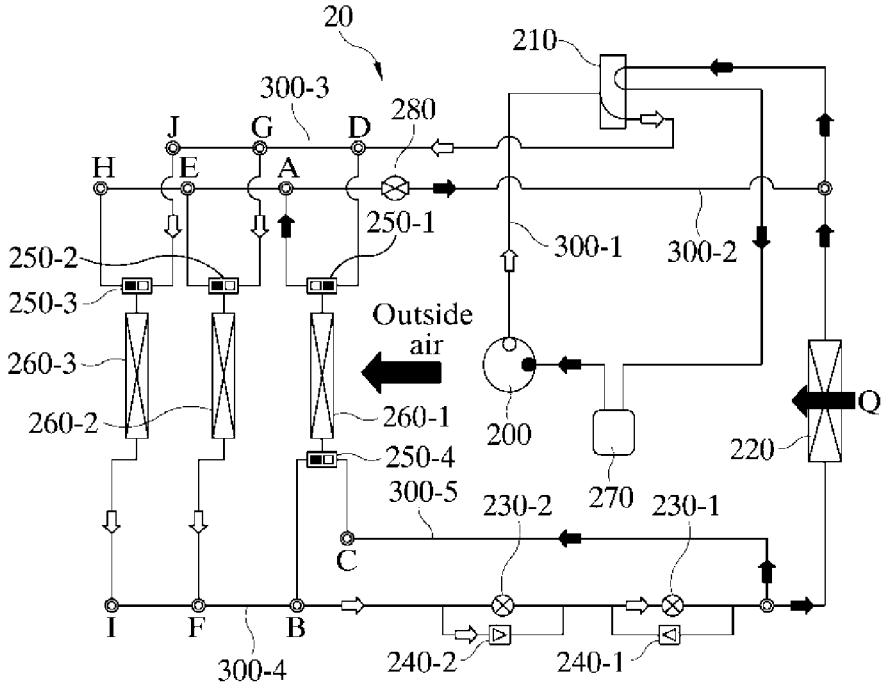
FIG. 14 is a schematic circuit diagram showing the alternating type heat pump according to the second embodiment of the present invention, wherein the first row of outdoor unit coil is operated as an evaporator to perform a cooling operation.

FIG. 14 is a schematic circuit diagram showing the alternating type heat pump according to the second embodiment of the present invention, wherein the first row of outdoor unit coil 260-1 is operated as an evaporator to perform a cooling operation. As shown in FIG. 14, the high temperature and high pressure gas refrigerant emitted from the compressor 200 is sent to the second and third rows of outdoor unit coils 260-2 and 260-3 via the four-way valve 210 and the third pipe 300-3 and is then condensed thereon.

So as to allow the high temperature and high pressure gas refrigerant to flow toward the second and third rows of outdoor unit coils 260-2 and 260-3, at this time, the second and third three-way valves 250-2 and 250-3 are opened by means of the controller in a forward direction, and so as to prevent the high temperature and high pressure gas refrigerant from flowing toward the first row of outdoor unit coil 260-1, at the same time, the first and fourth three-way valves 250-1 and 250-4 are closed by means of the controller.

The refrigerant condensed while being passed through the second and third rows of outdoor unit coils 260-2 and 260-3 is added on the fourth pipe 300-4 and is passed through the second check valve 240-2 and the cooling expansion valve 230-1. After that, a portion of the refrigerant flows along the fifth pipe 300-5, the fourth three-way valve 250-4, the first row of outdoor unit coil 260-1 and the second pipe 300-2, and the rest is sent to the indoor unit 220.

Therefore, as the first row of outdoor unit coil 260-1 is operated as an evaporator, it performs the heat exchanging with the outdoor air, thereby allowing the outdoor air temperature to be dropped. The cooled air is passed through the second and third rows of outdoor unit coils 260-2 and 260-3, thereby improving the condensing effects. The refrigerant evaporated while being passed through the indoor unit 220 and the refrigerant evaporated while being passed through the first row of outdoor unit coil 260-1 are added on the emitting part of the indoor unit 220 and are then absorbed to the compressor 220 via the four-way valve 210 and the accumulator 270, sequentially, thereby completing the cooling cycle under the conditions of the hottest weather.

As described above, the alternating type heat pump according to the present invention is provided with the plurality of three-way valves adapted to change the refrigerant circuits, such that the first to third rows of outdoor unit coils are selectively operated as a condenser or an evaporator in accordance with the load conditions and the temperature and humidity of the outdoor air in the heat pump, thereby improving the performance of the heat pump. Especially, the alternating type heat pump according to the present invention is capable of perfectly preventing the formation of the frost on the first to third rows of outdoor unit coils and permitting the continuous heating of the indoor space even under the conditions wherein the frost is formed during the heating operation in the winter seasons.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

I claim:

1. An alternating type heat pump having a compressor adapted to compress refrigerant, an accumulator adapted to keep liquid refrigerant from flowing to the compressor, a four-way valve adapted to allow the flow direction of the refrigerant passed through the compressor to be changed to a heating or cooling circuit, an indoor unit adapted to perform a heat exchanging operation between indoor air and the refrigerant, an outdoor unit adapted to perform a heat exchanging operation between outdoor air and the refrigerant, a first expansion valve adapted to reduce refrigerant temperature and pressure in accordance with a heating or cooling operation, and a first check valve disposed in parallel with the expansion valve, the first check valve and the first expansion valve adapted to control the flow direction of the refrigerant in one way, the heat pump comprising: a plurality of rows of outdoor unit coils disposed in the outdoor unit; and a plurality of three-way valves each disposed on at least one of front and rear ends of the three or more rows of outdoor unit coils and adapted to change the flow direction of the refrigerant, such that the rows of outdoor unit coils are selectively operated as a condenser or evaporator in accordance with the load conditions and outdoor air conditions;

and wherein the heat pump is capable of being operated at least in a standard heating mode, in a standard cooling mode and in a nonstandard heating mode;

wherein if the heat pump is operated in the standard heating mode, high temperature and high pressure refrigerant emitted from the compressor is all sent to the indoor unit via the four-way valve, and the refrigerant passed through the indoor unit is passed through the first check valve and the first expansion valve and flows to the rows of outdoor unit coils through the three-way valves, thereby emitting the refrigerant evaporated therefrom;

and wherein if the heat pump is operated in the nonstandard heating mode, high-temperature, high-pressure refrigerant emitted from the compressor is sent to at least one row of the outdoor unit coils operated as a condenser and to the indoor unit, and wherein refrigerant emitted from the indoor unit is added to refrigerant emitted from said at least one row of the outdoor unit coils operated as a condenser and then flows, through the first expansion valve, to at least one row of the outdoor unit coils being operated as an evaporator.

2. The alternating type heat pump according to claim 1, further comprising frosting sensors mounted at one end or both ends of the respective rows of outdoor unit coils so as to sense the outdoor unit coils to which defrosting is necessary or frosting may occur, and a controller adapted to control the plurality of three-way valves mounted at both ends of the respective rows of outdoor unit coils in accordance with the sensed signals from the frosting sensors.

3. The alternating type heat pump according to claim 1, wherein a second check valve is disposed in parallel to a second expansion valve, the second check valve and the second expansion valve adapted to control the flow direction of the refrigerant in a second way opposite said one way, wherein if the heat pump is operated in a standard cooling mode, high temperature and high pressure refrigerant emitted from the compressor is sent to the rows of outdoor unit coils through the three-way valves, and the refrigerant passed through the rows of outdoor unit coils is sent to the indoor unit through the second check valve and the second expansion valve, such that the indoor unit is operated as an evaporator and the rows of outdoor unit coils are operated as a condenser.

* * * * *